United States Patent [19]

Shastal

[11] Patent Number: 4,892,217

[45] Date of Patent: Jan. 9, 1990

[54] TAMPER EVIDENT DISPENSING CLOSURE

[76] Inventor: Eugene D. Shastal, 1149 S.E. Coral Reef St., Port St. Lucie, Fla. 34983

[21] Appl. No.: 217,477

[22] Filed: Jul. 11, 1988

[51] Int. Cl.[4] ..... B65D 51/22

[52] U.S. Cl. ..... 220/258; 220/266; 220/269; 220/335; 220/339; 220/153; 220/541

[58] Field of Search ..... 215/235; 220/258, 259, 220/265, 266, 268, 270, 339, 269, 276

[56] References Cited

U.S. PATENT DOCUMENTS

| | | | |
|---|---|---|---|
| 3,883,034 | 5/1975 | Rausing | 220/268 |
| 4,059,201 | 11/1977 | Foster | 220/258 |
| 4,291,818 | 9/1981 | Nozawa et al. | 215/235 X |
| 4,320,861 | 3/1982 | Rieke et al. | 222/541 |
| 4,359,169 | 11/1982 | Helms et al. | 220/258 |
| 4,361,250 | 11/1982 | Foster | 220/266 |
| 4,501,371 | 2/1985 | Smalley | 220/258 X |
| 4,516,689 | 5/1985 | Barker | 220/269 X |
| 4,669,640 | 6/1987 | Ando et al. | 220/266 X |
| 4,724,977 | 2/1988 | Cleevely et al. | 220/258 |
| 4,724,978 | 2/1988 | Cleevely et al. | 220/258 |
| 4,795,043 | 1/1989 | Odet et al. | 215/235 |

*Primary Examiner*—Stephen Marcus

*Assistant Examiner*—Nova Stucker

*Attorney, Agent, or Firm*—Wood, Dalton, Phillips, Mason & Rowe

[57] ABSTRACT

A closure is provided for selectively closing an opening of a container, including a base element arranged to be affixed to a container adjacent an opening therein. In one embodiment, the closure is provided with tamper-evident film fixed to the base element, and a control element is pivotally movable relative to the base element between open and closed position. When the base element is affixed to the container, the tamper-evident film obstructs the container opening. When the control element pivots to the open position, the tamper-evident film is visible, and can be punctured or otherwise removed. According to another embodiment of the invention, a closure is provided for a container having a tamper-evident film secured thereto overlying the opening in a container. The closure includes a control element having a puncturing element which is operable upon being pivoted in an inward direction to puncture the tamper-evident film to provide access to the container contents, and to provide an indication that access to the container has been had.

12 Claims, 5 Drawing Sheets

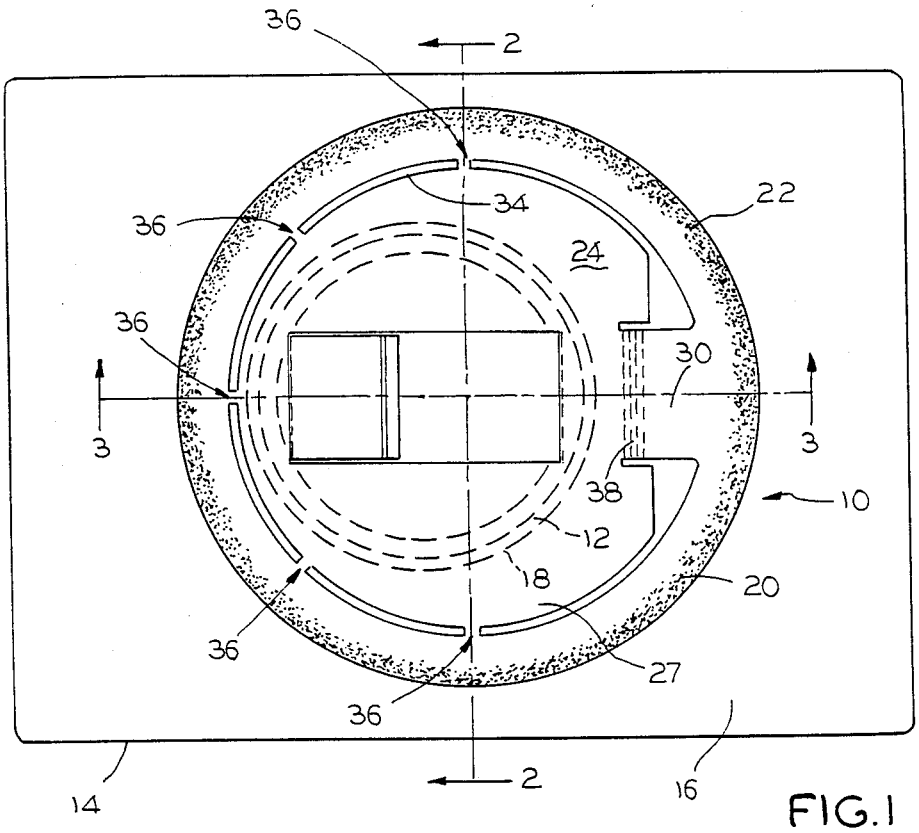
FIG.1
FIG.2
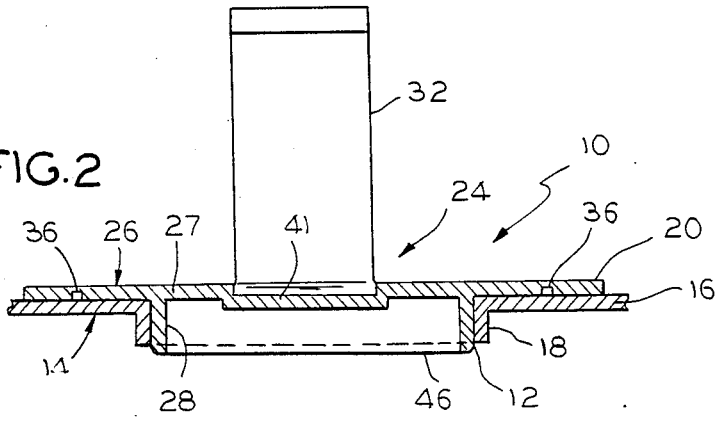
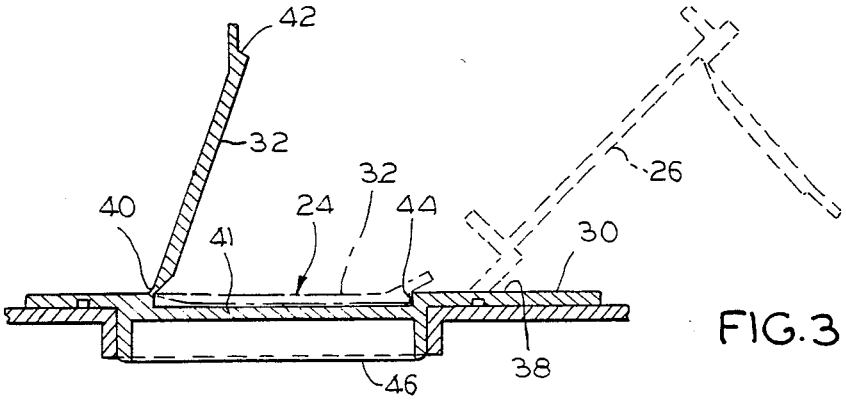
FIG.3

TAMPER EVIDENT DISPENSING CLOSURE

FIELD OF THE INVENTION

This invention relates generally to container closures, and more particularly to a tamper-evident dispensing container closure.

DESCRIPTION OF BACKGROUND ART

A closure such as is described in my copending application, Ser. No. 025,220, filed March 12, 1987, is mounted at an opening in an upper wall of a container. The closure includes a base element mounted to the container with a control element pivotally connected to the base element and including a stopper portion received in the container opening for selectively closing same. A frangible bridge is provided connecting the control element to the base element to provide indication that access to the opening has been had.

As an additional form of tamper protection, container openings have been provided with a tamper-evident seal, such as a foil or film sealed to the container opening. Such foil or film must be punctured or removed prior to dispensing the material stored in the container.

Such a tamper-evident seal presents a problem to a manufacturer in that it must be installed on the container. Typically this requires that an adhesive be applied between the foil or film and the container. This process renders the filling of the containers more difficult in that it must be done after the container is filled, resulting in possible damage to the material therein.

Such a tamper-evident seal also presents a problem to a consumer who must puncture or remove the seal to gain access to the material in the container. Often, this requires that the closure be removed to puncture or remove the seal or that an instrument be utilized to puncture the foil or film when the closure is placed in an open position.

The present invention is intended to overcome these and other problems associated with prior closures.

SUMMARY OF THE INVENTION

In accordance with one embodiment of the present invention, a closure is provided which includes a tamper-evident seal secured thereto.

Broadly, there is disclosed herein a tamper-evident closure for selectively closing the opening of a container. The closure includes a base element having means for affixation thereof to a container adjacent a container opening. A control element has a stopper portion adapted to be received in the container opening and manipulating means for withdrawing the stopper portion from the container opening. Sealing means are secured to the closure for obstructing the container opening when the base element is affixed to the container.

The closure according to the one embodiment of the invention is of unitary construction and includes the base element having a through opening. Means are provided for affixing the base element to the container so that the base element opening is in alignment with the container opening. Such affixation means may include threadable connection means, adhesive, or a heat weld. A control element is pivotally connected to the base element using a living hinge. The control element includes a stopper portion adapted to be received in the container opening in a first position, and a handle portion pivotally connected to the stopper portion for engagement by a user to pivot the control element to withdraw the stopper portion from the container opening in a second position. A tamper-evident film is secured to the base element. When the closure is installed onto the container, as by affixing the base element thereto, the film overlays the container opening. Pivoting the stopper portion to its first position causes the film to be stretched across the opening, resulting in a tamper-evident seal. Subsequently, when the stopper portion is withdrawn, the film remains across the container opening to obstruct same. In order to dispense the material in the container, the film must be punctured or removed.

It is another feature of the invention that frangible connecting means are provided between the stopper portion and the base element to provide an indication when the stopper portion has been withdrawn from the container opening.

In accordance with another embodiment of the present invention, a closure is provided including means for puncturing a tamper-evident seal extending across an opening on a container.

Broadly, according to this other aspect of the invention, a closure is provided for selectively closing an opening of a container, which container includes a tamper-evident seal, such as a film, extending across the opening. The closure includes a base element and means for affixing the base element to a container adjacent an opening in the container so that the seal extends across the container opening and is disposed between the base element and the container. A control element has a connecting portion pivotally mounted to the base element, a stopper portion adapted to be received in the container opening in a first position, a puncturing portion including means for puncturing a tamper-evident seal on a container if the stopper portion is moved to a second position, and a gripper portion adapted to be engaged by a user to pivot the control element to withdraw the stopper portion from the container opening in a third position.

More specifically, the closure includes a base element which can be affixed to the container by any known means, such as by threaded means or adhesive so that a seal extending across the container opening is disposed between the base element and the container to inhibit dispensing material stored in the container. A control element is formed integrally with the base element. The control element includes a connecting portion, a stopper portion, a puncturing portion, and a gripping portion. The stopper portion is adapted to be received in the base element opening in a first position. The puncturing portion is integral with the stopper portion and includes means for puncturing a tamper-evident seal on the container if the stopper portion is moved to a second position. The gripper portion is integral with the stopper portion and is adapted to be engaged by a user to pivot the control element to withdraw the stopper portion from the container opening at a third position.

According to yet another aspect of the invention, the closure is provided with a frangible connecting means between the base element and the control element for permitting movement of the stopper portion only with the connecting means are broken.

According to another aspect of the invention, the connecting means comprises a bridge portion connected to the base element, and the closure further includes a tear section between the bridge portion and the control element.

According to still another aspect of the invention, the connecting means comprises a tear away bridge element frangibly connected to the base element and to the control element so that the bridge element can be removed by a user thereof prior to dispensing material from the container.

Further features and advantages of the invention will readily be apparent from the specification and from the drawings.

BRIEF DESCRIPTION OF THE DRAWINGS

FIG. 1 is a top plan view of a closure embodying one form of the invention mounted on a container;

FIG. 2 is a sectional view taken along the lines 2—2 of FIG. 1;

FIG. 3 is a sectional view taken along the lines 3—3 of FIG. 1;

DETAILED DESCRIPTION OF THE INVENTION

Figure 4:
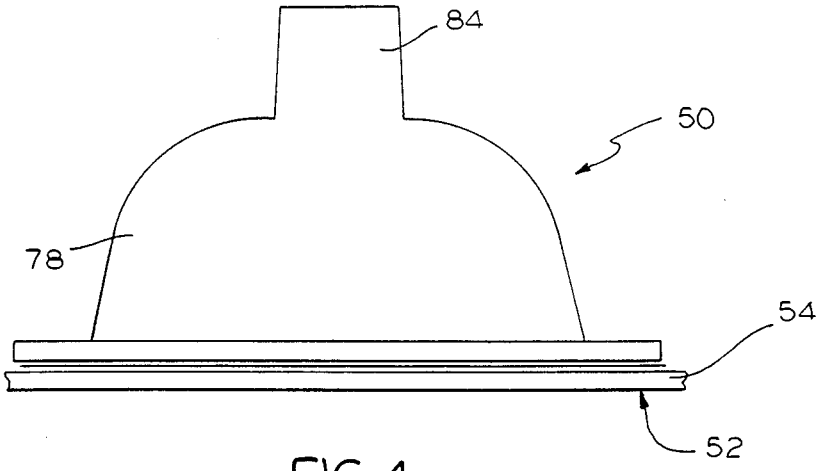
FIG. 4 is a side elevational view of a closure embodying another form of the invention mounted on a container.
Figure 5:
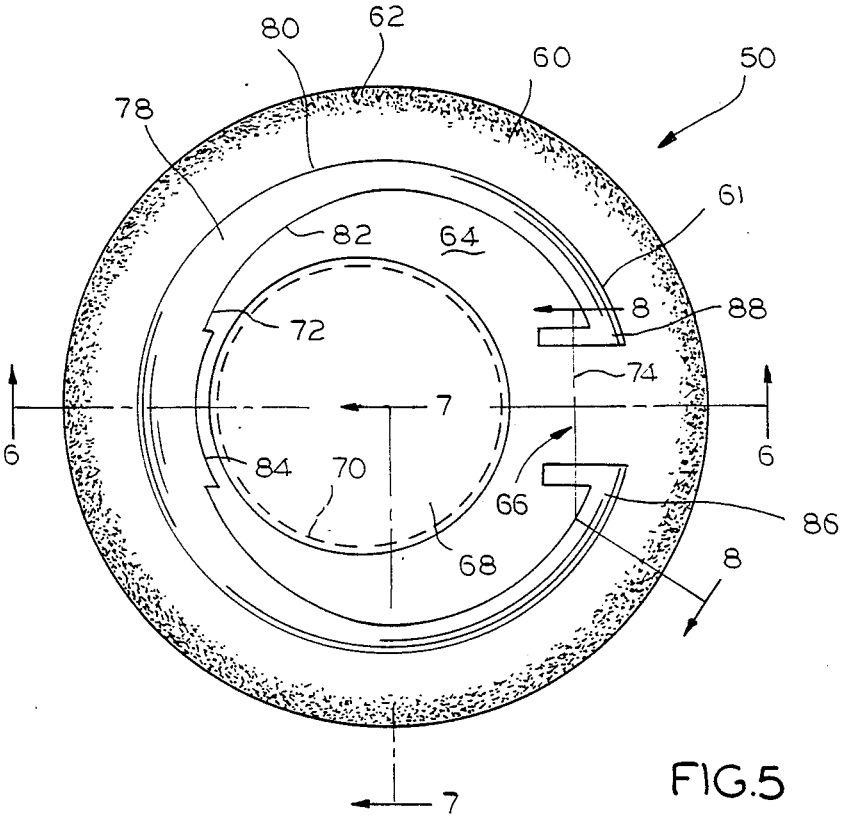
FIG. 5 is a top plan view of the closure of FIG. 4.

Referring to FIGS. 1–3, a closure 10 according to a first embodiment of the invention is shown for selectively closing an opening 12 in a container 14. In the illustrated embodiment, the container 14 is in the form of a can having a planar top wall 16 connected to an inwardly turned cylindrical sleeve 18. The inner surface of the sleeve 18 defines the boundaries of the container opening 12. As will be obvious to those skilled in the art, the inventive concept is adapted for use with different forms of containers in the broad scope of the invention.

The closure 10 includes a base element 20 having means 22 for affixation thereof to the container 14. The base element 20 is of planar construction and is generally circular in shape and includes a generally circular opening 23 therethrough. In the illustrated embodiment, the affixation means comprises an adhesive layer 22 provided along the outer peripheral edge of the base element 20. Specifically, the base element 20 is affixed to the container top wall 16 so that the base element opening 23 completely surrounds the container opening 12.

The specific form of the affixation means is largely dependent on the type of container 14. For example, the base member 20 could include a sleeve portion having an internal thread for mating with a thread on the neck of a bottle. Similarly, the closure could be affixed to the container using any other known means, as will be obvious to those skilled in the art.

Centrally positioned relative to the base element 20 is a control element 24 having a stopper portion 26 including a planar wall 27 and a cylindrical sleeve 28 extending perpendicularly therefrom. The cylindrical sleeve 28 has an outer diameter approximately the size of the inner diameter of the container sleeve 18 so that the stopper portion sleeve 28 is adapted to be received in the container opening 12 in a first, closed position, of the closure 10, as shown in FIGS. 1 and 2, and in solid lines in FIG. 3.

The control element 24 is formed integrally with the base element 20 and includes a connecting portion 30 and a handle or gripper portion 32. A plurality of discontinuous slits 34 separate the base element 20 from the control element 24. The slits 34 are separated by bridges 36 extending between the control element 24 and the base element 20. The bridges 26 are readily observable by a user of the closure 10, and define a frangible connecting bridge therebetween. The bridges 36 maintain the stopper portion planar wall 27 flush with the base element 20 until such time as the bridges 36 are broken. Therefore, the bridges 36 serve as an indicator as to whether the closure has been opened in the past, i.e., the stopper portion 26 has been removed upwardly from the container opening 12. The arrangement of the closure structure is such that the stopper portion 26 cannot be removed sufficiently from the opening 12 to permit entrance to the container in the absence of breaking the bridges 36, thereby causing the closure to be a tamper-evident closure.

The control element 24 is pivotally connected to the base element 20 by a living hinge 38 formed in the connection portion 30. Similarly, the handle 32 is connected to the stopper portion 26 with a living hinge 40 opposite the first living hinge 38. The handle 32 pivots at the hinge 40 so that it can be stored in a recess 41 in the stopper portion 26. The distal end of the handle 32 includes a locking surface 42 receivable in a detent 44 at the end of the recess 41 opposite from the hinge 41. The full closed position of the closure 10 is illustrated in FIG. 3, with the handle 32 illustrated in phantom. To open the closure, the user grasps the distal end of the handle 32, and pivots it upwardly to the position shown in solid line in FIG. 3. Subsequently, the user pulls upwardly on the handle 32, thereby breaking the bridges 36 causing the control element 24 to pivot at the living hinge 38 to remove the stopper portion sleeve 28 from the container opening 12, so that the stopper portion 26 is in a second, or open, position, illustrated fully in phantom in FIG. 3.

In order to provide a closure, and also container, which is further tamper-evident, a container opening sealing device, such as, for example, film 46 is secured to the closure 10. Preferably, the film 46 is a punctuable film of circular shape, similar to the shape of the base element 24. The film 46 is secured at its outer peripheral edge to the base element 20 on the same side as the sleeve 28. Accordingly, the film 46 extends across the base element opening 23 and the opening defined by the sleeve 28. When the closure 10 is affixed to the container 12, the outer edge of the film 46 is disposed between the container top wall 16 and the base element 20 and the central portion of the film 46 is tightly stretched across the opening 12 and is held between the outer surface of the control element sleeve 28 and the inner surface of the container sleeve 18.

Assuming the closure 10 is installed on a container, when the closure is first moved to the open position, as discussed above, the film 46 remains across the container opening 17 and obstructs the same. In order for a user to dispense material inside the container, the film 46 must be punctured, cut away, or otherwise removed.

Accordingly, the film 46 provides a second indication to the user when the container has been opened, more specifically, an indication that the seal has been broken so that the material contained within the closure container 14 had been tampered with.

Once opened, the closure 10 can be returned to the closed position, shown in solid lines in FIG. 3, by urging the stopper portion in a counter-clockwise direction about the hinge 38 wherein the stopper portion planar wall 27 again flush with the base element 20. Also, the handle 32 can be returned to the locked position so that it is substantially flush with the base element 20.

Thus, according to the first embodiment of the invention, a closure 10 is premanufactured with a tamper-evident seal, eliminating the step of securing such a seal directly to a container after the container has been filled.

Referring to FIGS. 4–8, a closure 50 according to a second embodiment of the invention is illustrated. Particularly, the closure 50 is provided with means for puncturing a container seal, such as the seal 46 discussed above relative to FIGS. 1–3.

The closure 50 is adapted for use with a container, generally designated 52, having a top wall 54 and an access opening 56 therethrough. A tamper-evident seal, such as a film, 58 extends across the opening 56. Specifically, the film 58 is adhered to the top wall 54 to obstruct the opening 56. In order to obtain dispense the contents of the container 52, the seal 58 must be punctured or removed.

The closure 50 includes a planar, circular shaped base element 60, having a central circular opening 61 therethrough. Means, such as an adhesive 62, is provided for affixing the base element 60 to the container top wall 54 so that the base element opening 61 fully surrounds the container opening 56. As above, the base element 60 can be affixed to the container 52 by any known means, as will be obvious to those skilled in the art.

Centrally of the base element 60 is a control element 64 formed integrally therewith. The control element 64 includes a connecting portion 66, a stopper portion 68, a puncturing portion 70, and a gripper portion 72.

The pivoting portion 66 includes a living hinge 74 pivotally connecting the generally planar stopper portion 68 to the base element 60, opposite the gripper portion 72. In a first position, shown in solid line in FIG. 6, the stopper portion 68 overlays the opening 56, and extends diagonally upwardly from the hinge 74 terminating at the gripper portion 72. The puncturing portion 70 comprises a generally cylindrical shaped member extending downwardly from the stopper portion 68 and diverging to a puncturing edge 76, which edge may be, for example, a serated edge. The puncturing portion 70 is oriented relative to the stopper portion 68 at an angle similar to the angle between the base element and the stopper portion 68. Therefore, as is apparent, the length of the sleeve 70 is shortest on the side closest to the hinge 74, and is longest at the side closest to the gripper portion 72. Resultantly, in the position as shown, the puncturing edge 76 is disposed immediately above the seal 58 with the closure 50 installed on the container 52.

To maintain the control element 64 in spaced relation with the film 58 prior to being open by a user, a bridge, or retaining element 78 is tear connected to the base element 60 at a lower edge 80 and is tear connected to the peripheral edge of the stopper portion 68 at an upper edge 82. The retaining element 78 also includes a tab 84. The tear connection edges 80 and 82 may be, for example, a continuous thin tearable section, saw toothed design tear connection or a plurality of tear tabs separating a discontinuous slit.

To gain access to the container contents, a user can first remove the retaining element 78, as by grasping on the tab 84 and applying a force to break the tear connection edge 82 between the retaining element 78 and the stopper portion 68. Subsequently, the tear connection edge 80 can be broken between the retaining element 78 and the base element 60 to provide for complete removal of the retaining element 78, indicated by the darkened area in FIG. 5. With the retaining element 78 removed, a user can depress the control element stopper portion 68 so that the puncturing edge 76 punctures the film 58 as the stopper portion 68 is pivoted in the counter-clockwise direction to a second position as indicated in phantom by the stopper portion 68' and puncturing element 70'. The seal 58 is then punctured in circular form, corresponding to the shape of the puncturing portion 70. The innerside of the puncturing portion 70 may contain an adhesive, or mechanical means, for retaining the cut away portion of the film 58'. To open the container, a user thereafter grips the gripper portion 72 and pivots the stopper portion 68 in a clockwise direction to a third position, illustrated by the stopper portion 68'' in phantom FIG. 6, to dispense the material stored in the container 52.

As an alternative to the tab 84, the retaining element 78 could be provided with a tab or other structure at its opposite ends 86 or 88, adjacent the hinge 74. In either case, a user graps either tab 86 or 88 and pulls to remove the retaining element 78 as by breaking the tear connections 80 and 82.

Figure 6:
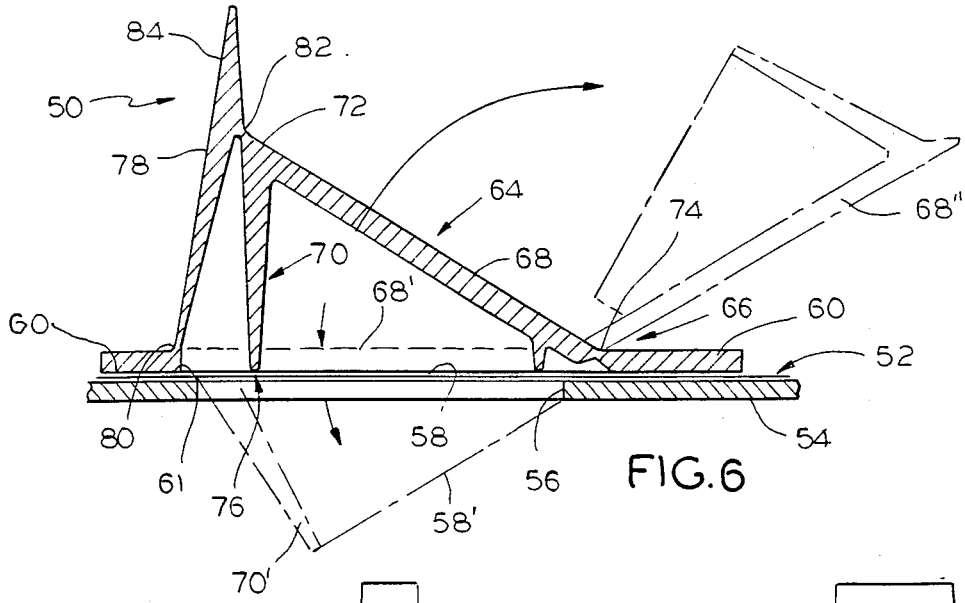
FIG. 6 is a sectional view taken along the lines 6—6 of FIG. 5.
Figure 7:
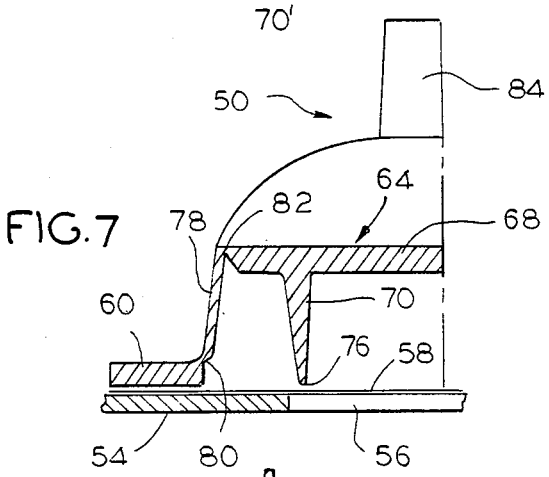
FIG. 7 is a sectional view taken along the lines 7—7 of FIG. 5.
Figure 8:
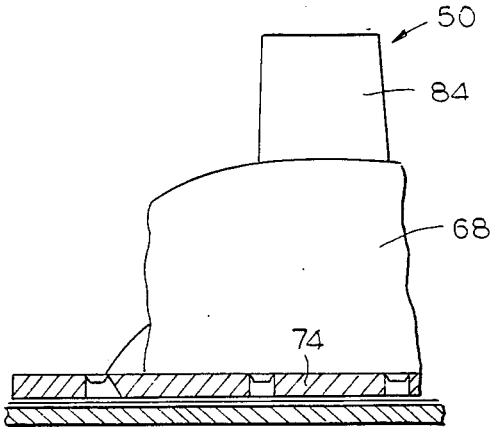
FIG. 8 is a sectional view taken along the lines 8—8 of FIG. 5.
Figure 9:
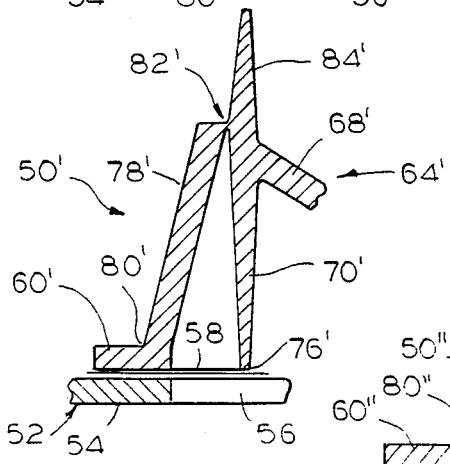
FIG. 9 is an alternative form of the closure of FIGS. 4–8.

Referring to FIG. 9, a partial sectional view, similar to that of FIG. 6, of a closure 50' according to an alternative form of the second embodiment is illustrated. Accordingly, like reference numerals indicated with a prime indicate like elements. The principal difference between the embodiments of FIG. 6 and FIG. 9 is that the tab 84' is integrally formed with the control element 64', rather than the retaining element 78', and acts as a gripper portion. Also, the tear connection edge 82' is provided between the stopper portion 84' and the retaining element 78', but a solid connection edge 80' is provided between the base element 60' and the retaining member 78'. Resultantly, to gain access using the closure 50', a user grasps on the tab 84' and pulls it in the clockwise direction to break the tear connection 82'. Subsequently, the stopper portion 68' is moved in the counter-clockwise direction so that the puncturing portion 70' punctures the seal 58 to gain access to the inside of the container 52. In this case, the retaining element 78' remains secure to the base element 60' and can be used in dispensing contents from the container 52.

Figure 10:
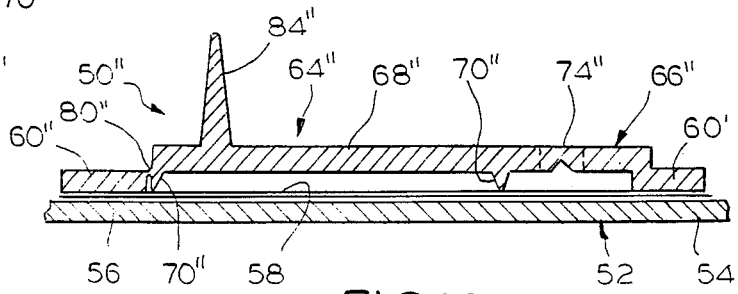
FIG. 10 is another alternative form of the closure of FIGS. 4–8.

With reference to FIG. 10, a closure 50'' according to a third form of the second embodiment is illustrated wherein like reference numerals with double prime indicate like elements relative to FIG. 6, above.

The closure 50'' is similar to the closure 50, see FIGS. 4–8, except that the retaining element 78 is omitted. Instead, the stopper portion 68'' in the first position extends substantially parallel to the film seal 58, and the tear connection edge 80'' is provided between the base element 60'' and the stopper portion 68'' adjacent the tab 84'' which is affixed the stopper portion 68''. Also, the puncturing portion 70'' is a shortened cylindrical portion, with the length determined by the spacing between the stopper portion 68″ and the film 58. In use, the tear connection 80″ is broken by grasping the tab 84″ and swinging the stopper portion 68″ in a clockwise direction. Subsequently, the stopper element 68″ is swung about its hinge 74″ in the counter-clockwise direction so that the puncturing portion 70″ punctures the film 58. Pivoting the stopper portion 68″ again in the clockwise direction provides access to the contents of the container 52.

In each of the above-described forms of the puncturing closure 50, 50′ and 50″, the closure is provided with a puncturing element for puncturing a film seal adhered to an opening on the container, without the necessity of removing the closure or using a utensil. Similarly, each closure is provided with frangible connecting means for providing an indication the closure itself has been tampered with.

In addition to the above, a tamper-evident puncturing closure could be provided with a tamper-evident film seal secured to the base element of the closure.

The foregoing disclosure of the specific embodiments is illustrative of the broad inventive concepts comprehended by the invention.

I claim:

1. A tamper-evident closure for selectively closing an opening of a container, said closure comprising:

a base element having a central opening larger than the container opening and means for affixation of the base element to the container so that the container opening is disposed entirely within said central opening;

a control element integral with said base element and disposed inwardly of said base element central opening and having a stopper portion including a sleeve having an outer diameter substantially identical to an inner diameter of the container opening and adapted to be received in the container opening, and manipulating means for withdrawing the stopper portion from the container opening; and a puncturable film secured to said closure base element and extending across the base element central opening and held between said sleeve and the container opening for obstructing the container opening when said base element is affixed to the container.

2. The closure of claim 1 wherein said base element defines an outer surface and said control element defines an outer surface disposed substantially flush with said base element outer surface when the stopper portion is received in the container opening.

3. The closure of claim 1 further comprising a frangible bridge connected between said control element and said base element disposed to be observable by the user when attempting to withdraw the stopper portion from said container opening.

4. The closure of claim 1 wherein said stopper portion sleeve stretches said film into engagement with the container opening when the stopper portion sleeve is received therein.

5. A tamper-evident closure for selectively closing an opening of a container, said closure comprising:

a base element having a central opening larger than the container opening and means for affixation of the base element to the container so that the opening in the container is disposed entirely within said central opening;

a control element integral with said base element having a connecting portion pivotally mounted to said base element, a stopper portion comprising a sleeve having an outer diameter substantially identical to an inner diameter of the container opening adapted to be received in the container opening in a first position, and a gripper portion adapted to be engaged by a user to pivot the control element to withdraw the stopper portion sleeve from the container opening in a second position; and a tamper-evident film secured to said base element and extending across the base element opening and held between said sleeve and the container opening for obstructing the opening of the container when said base element is affixed to the container.

6. The closure of claim 5 wherein said base element defines an outer surface and said control element defines an outer surface disposed substantially flush with said base element surface when the control element is disposed in said first position.

7. The closure structure of claim 5 wherein said base element defines a through opening and said control element is received fully within said opening in said first position.

8. The closure structure of claim 5 wherein said gripper portion comprises a handle pivotally connected to said stopper portion.

9. The closure of claim 8 wherein said base element defines an outer surface and said control element defines an outer surface disposed substantially flush with said base element outer surface when the control element is disposed in said first position, and said handle includes an outer surface disposed substantially flush with said base element when said handle is in a locked position.

10. The closure of claim 5 further comprising a frangible bridge connected between said control element and said base element disposed to be observable by the user when attempting to withdraw the stopper portion from said container opening.

11. The closure of claim 5 wherein said stopper portion comprises a cylindrical sleeve receivable in a circular opening of a container.

12. The closure of claim 11 wherein said film is secured to said base element and extends across said cylindrical sleeve and is thereby stretched across the container opening when the cylindrical sleeve is received in a container opening.

* * * * *